US011835258B1

(12) United States Patent
Alfonso

(10) Patent No.: US 11,835,258 B1
(45) Date of Patent: Dec. 5, 2023

(54) EXHAUST VENT ASSEMBLY WITH SELECTIVELY REMOVABLE TOP

(71) Applicant: Carlos Alfonso, Spring Hill, FL (US)

(72) Inventor: Carlos Alfonso, Spring Hill, FL (US)

( * ) Notice: Subject to any disclaimer, the term of this patent is extended or adjusted under 35 U.S.C. 154(b) by 0 days.

(21) Appl. No.: 18/134,225

(22) Filed: Apr. 13, 2023

(51) Int. Cl.
*F24F 7/04* (2006.01)
*F24F 13/02* (2006.01)
*F24F 13/08* (2006.01)
*F24F 7/00* (2021.01)

(52) U.S. Cl.
CPC ..... *F24F 7/04* (2013.01); *F24F 13/029* (2013.01); *F24F 13/0209* (2013.01); *F24F 13/084* (2013.01); *F24F 2007/001* (2013.01)

(58) Field of Classification Search
CPC .. F24F 7/04; F24F 2007/001; F24F 13/00209; F24F 13/029; F24F 13/084
USPC ..... 454/358, 366
See application file for complete search history.

(56) References Cited

U.S. PATENT DOCUMENTS 3,742,659 A * 7/1973 Drew ..... F24F 13/00 52/27
4,615,263 A * 10/1986 Titterud ..... B60J 7/1642 454/94
5,344,363 A 9/1994 Pollock
5,547,422 A 8/1996 Seboldt
5,591,080 A 1/1997 Ward
5,632,678 A * 5/1997 Doelfel ..... F24F 7/02 454/366
5,662,522 A 9/1997 Waltz
6,302,788 B1 10/2001 Gagnon
6,361,433 B1 3/2002 Gray
6,716,099 B2 * 4/2004 Pfleiderer ..... F24F 7/02 454/41
6,772,538 B2 8/2004 Vagedes
6,974,379 B2 12/2005 Koessler
6,994,622 B2 2/2006 Koessler
7,147,554 B1 12/2006 Berger
7,731,574 B2 * 6/2010 Milks ..... B60J 7/1642 454/94
9,193,246 B2 * 11/2015 Wood ..... B60H 1/245
9,435,556 B1 * 9/2016 Chwala ..... F24F 7/02
9,850,620 B2 12/2017 Ott
9,869,488 B2 * 1/2018 Glenn ..... E05D 11/1078
10,222,088 B2 * 3/2019 Whitehead ..... F24F 13/14
10,267,533 B2 4/2019 Mantyla et al.
11,460,201 B2 * 10/2022 Daniels, II ..... F24F 11/30
(Continued)

*Primary Examiner* — Avinash A Savani
*Assistant Examiner* — Dana K Tighe
(74) *Attorney, Agent, or Firm* — Mark C. Johnson; Johnson Dalal

(57) ABSTRACT

An exhaust vent assembly with selectively removable top wall that includes an exhaust vent body with a base wall, two opposing sidewalls, a rear wall, and the top wall that is capable of being removed from the sidewalls to provide access to the inside (or vent channel) of the exhaust vent assembly. The top wall is capable of having a closed position with the top wall secured and covering the upper edges of the two opposing sidewalls and with a mesh screen coupled to the exhaust vent body that is capable of preventing animals, certain insects, and other matter from entering the vent channel. The top wall is configured to have an open position with the top wall substantially uncovering the upper edges of the two opposing sidewalls and providing access to the vent channel.

18 Claims, 7 Drawing Sheets

(56) References Cited

U.S. PATENT DOCUMENTS

| | | | |
|---|---|---|---|
| 2006/0025067 | A1 | 2/2006 | Koessler |
| 2011/0097990 | A1 | 4/2011 | Charron |

* cited by examiner

EXHAUST VENT ASSEMBLY WITH SELECTIVELY REMOVABLE TOP

FIELD OF THE INVENTION

The present invention relates generally to exhaust assemblies and, more particularly, relates to exhaust vent assemblies attachable to a building structure and operably configured to permit access to the internal channel defined therein.

BACKGROUND OF THE INVENTION

Exhaust vents are well known structures operably configured to couple with a building structure and conduit that is disposed within the building structure. The conduit fluidly coupled to the exhaust vent is spread out through the building structure and often terminates in a kitchen, bathroom, dryer, or other room inside the house that is desired to be vented. Most exhaust vents are made with water resistant sheet metal that is formed into a structure with a base, opposing sidewalls, a rear wall, and a cover or top wall. These pieces of sheet metal or permanently fastened together with, for example, welding or semi-permanently fastened together with, for example, fasteners. Exhaust vents also define a front exhaust port where air and other material is exhausted into the ambient environment.

One common problem of many known exhaust vents is debris, animals, insects, rain, and other outside environmental substances entering through the exhaust port, which can clog the conduit or lead to said substances entering the building structure. To combat against said problem, many known exhaust vents have a curved or angled cover or top wall and, in some instances, utilize a grate, louver slats, or other inhibiting structures that partially restrict access to the exhaust port, yet still allow air to flow therethrough. Most of these known inhibiting structures are also permanently or semi-permanently coupled to one or more of the walls forming the exhaust vent, thereby making very difficult, if not impossible, to access the exhaust vent channel or the nearby conduit. This can be problematic for many users that desire to clean out a conduit or assess where a clog or blockage may be in the conduit.

For example, the structure of most known exhaust vents requires a user to access the conduit through an attic or other area that is difficult to reach by the user or does not effectively or efficiently allow a user to assess where in the conduit a clog may be located. Some known exhaust vents have inhibiting structures that are configured to be open and closed, but due to the curved hood orientation of the upper wall of the exhaust vent, accessing the conduit or vent channel is also difficult or impracticable. Furthermore, if the exhaust vent is coupled to the roof of the building structure, difficulty in accessing the conduit or vent channel is exacerbated.

Therefore, a need exists to overcome the problems with the prior art as discussed above.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

SUMMARY OF THE INVENTION

Figure 1:
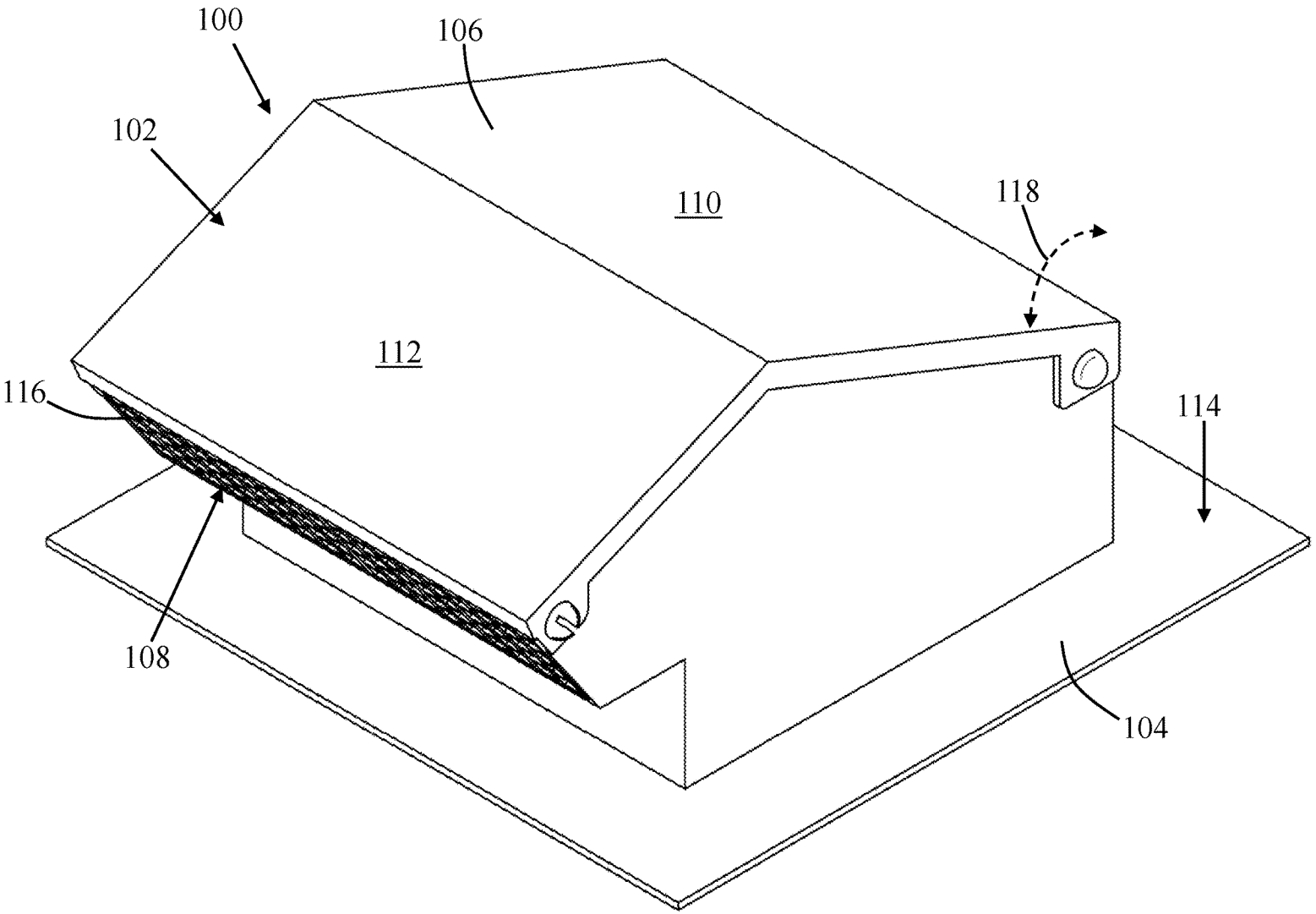
FIG. 1 is an overhead perspective view of an exhaust vent assembly with selectively removable top in accordance with one embodiment of the present invention.

The invention provides an exhaust vent assembly with selectively removable top that overcomes the hereinaforementioned disadvantages of the heretofore-known devices and methods of this general type and that provides an exhaust vent couplable to a building structure and operable to more efficiently and effectively access the vent channel and conduit couplable to the exhaust vent.

With the foregoing and other objects in view, there is provided, in accordance with the invention, an exhaust vent assembly with selectively removable top that includes an exhaust vent body having a base wall defining a conduit aperture and two opposing sidewalls coupled to the base wall and each having an upper edge and a front edge defining an exhaust port opening, wherein the upper edges defining an upper aperture. The body also includes a rear wall coupled to, and interposed between, the two opposing sidewalls and a top wall translatably coupled thereto. The assembly also includes a mesh screen coupled to the exhaust vent body, wherein the top wall is operably configured to have a closed position along a top wall translation path with the top wall translatably secured and covering the upper edges of the two opposing sidewalls and the upper aperture, with the mesh screen covering the exhaust port opening, and defining a vent channel enclosed by the top wall, two opposing sidewalls, and base wall that spans from the mesh screen to the conduit aperture and an open position along the top wall translation path with the top wall substantially uncovering the upper edges of the two opposing sidewalls and the upper aperture.

In accordance with a further feature of the present invention, the two opposing sidewalls and the rear wall are fixedly attached to the base wall in an upright orientation.

In accordance with another feature, an embodiment of the present invention includes the base wall having an upper surface and a bottom surface opposing the upper surface of the base wall and an annular adapter member coupled to the base wall and extending in a direction away from the bottom surface of the base wall, wherein the annular adapter member defines the conduit aperture.

In accordance with an additional feature of the present invention, the top wall is rotatably coupled to at least one of the two opposing sidewalls and the rear wall.

In accordance with yet another feature of the present invention, the top wall also includes a first portion rotatably and directly coupled to the at least one of the two opposing sidewalls and the rear wall and extending in a direction away from an upper surface of the base wall and a second portion integrally coupled with the first portion of the top wall and extending in direction toward the upper surface of the base wall. In accordance with an additional feature of the present invention, at least one top locking aperture is defined by the second portion and at least one base locking aperture is defined by at least one of the two opposing sidewalls, wherein the closed position includes the at least one top locking aperture and the at least one base locking aperture aligned with one another and the top wall rotatably secured with at least one fastener disposed through the at least one top locking aperture and the at least one base locking aperture.

In accordance with an additional feature of the present invention, the mesh screen is directly coupled and fastened the two opposing sidewalls and the at least one top locking aperture and the at least one base locking aperture are interposed between the mesh screen and the rear wall.

In accordance with yet another feature of the present invention, the top wall is rotatably coupled to the exhaust vent body and the closed position includes the top wall rotationally secured with at least one fastener.

In accordance with another feature, an embodiment of the present invention includes at least one top locking aperture defined by the top wall and at least one base locking aperture defined by at least one of the two opposing sidewalls, wherein the closed position includes the at least one top locking aperture and the at least one base locking aperture aligned with one another and the top wall rotatably secured with the least one fastener disposed through the at least one top locking aperture and the at least one base locking aperture. In accordance with a further feature of the present invention, the mesh screen is directly coupled and fastened the two opposing sidewalls and the at least one top locking aperture and the at least one base locking aperture are interposed between the mesh screen and the rear wall.

In accordance with yet another feature of the present invention, the mesh screen separates the front edges of each of the two opposing sidewalls.

In accordance with an exemplary feature of the present invention, the top wall is rotatably coupled to the two opposing sidewalls proximal to a back end of the top wall and rotatably secured to the opposing sidewalls proximal to a front end of the top wall when in the closed position.

Also in accordance with the present invention, an exhaust vent assembly with selectively removable top is disclosed that includes an exhaust vent body having a base wall defining a conduit aperture, two opposing sidewalls coupled to the base wall and each having an upper edge defining an upper aperture and a front edge defining an exhaust port opening with a mesh screen disposed therein and coupled to the exhaust vent body, a rear wall coupled to, and interposed between, the two opposing sidewalls, and a top wall that is rotatably coupled to the two opposing sidewalls proximal to a back end of the top wall with at least one fastener, is rotatably secured to the opposing sidewalls proximal to a front end of the top wall with at least one fastener, and is disposed over the upper edges of the two opposing sidewalls and the upper aperture, wherein the top wall, the two opposing sidewalls, and the base wall define an enclosed vent channel spanning from the mesh screen to the conduit aperture.

Although the invention is illustrated and described herein as embodied in an exhaust vent assembly with selectively removable top, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. Unless otherwise indicated by Applicant, the figures of the drawings are not necessarily drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the exhaust vent, i.e., from the front of the exhaust event assembly where the mesh screen or opening is located to a rear wall or, the rotational direction of the top of the exhaust vent.

DETAILED DESCRIPTION OF THE INVENTION

While the specification concludes with claims defining the features of the invention that are regarded as novel, it is believed that the invention will be better understood from a consideration of the following description in conjunction with the drawing figures, in which like reference numerals are carried forward.

Figure 2:
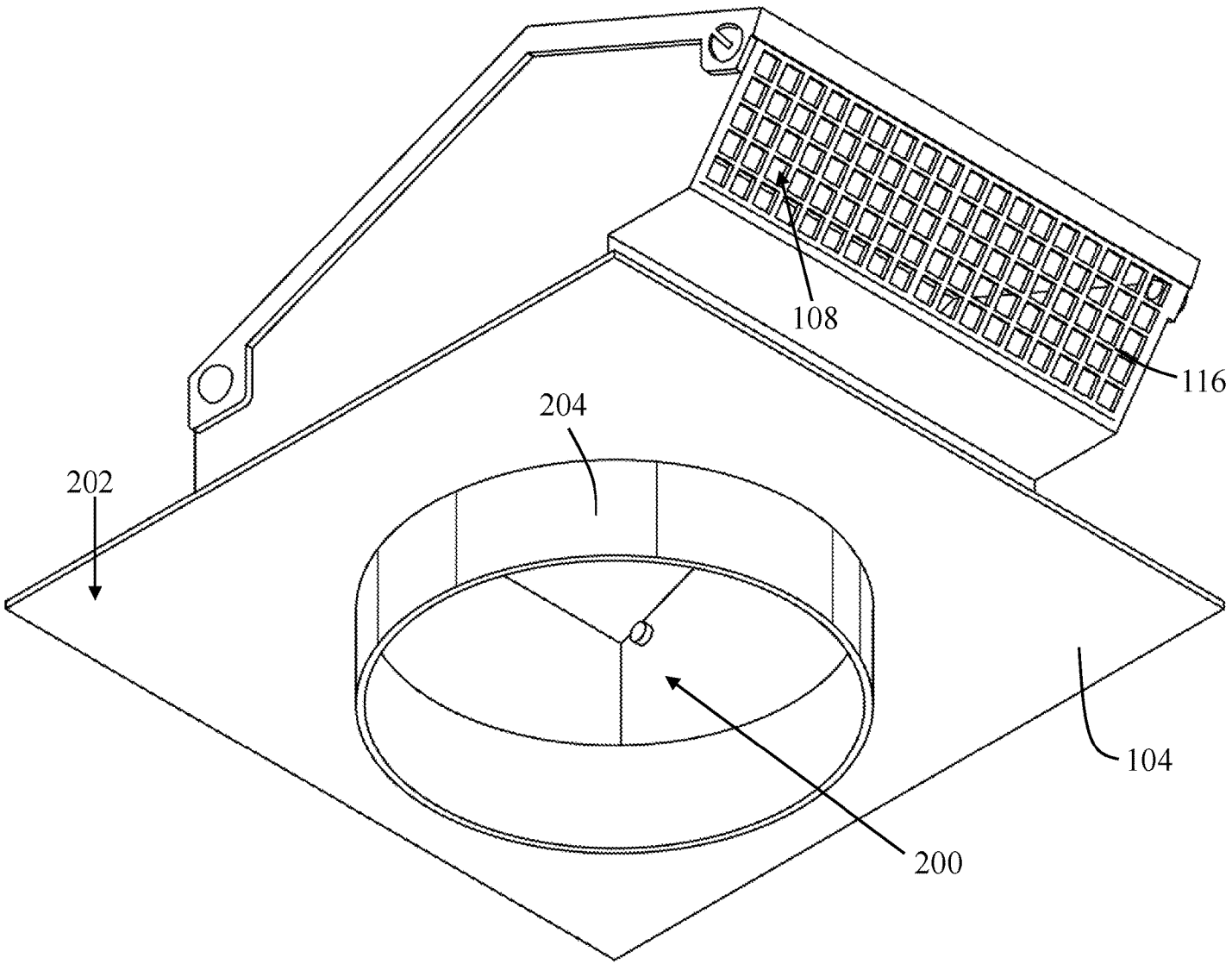
FIG. 2 is a bottom perspective view of the exhaust vent assembly in FIG. 1.
Figure 3:
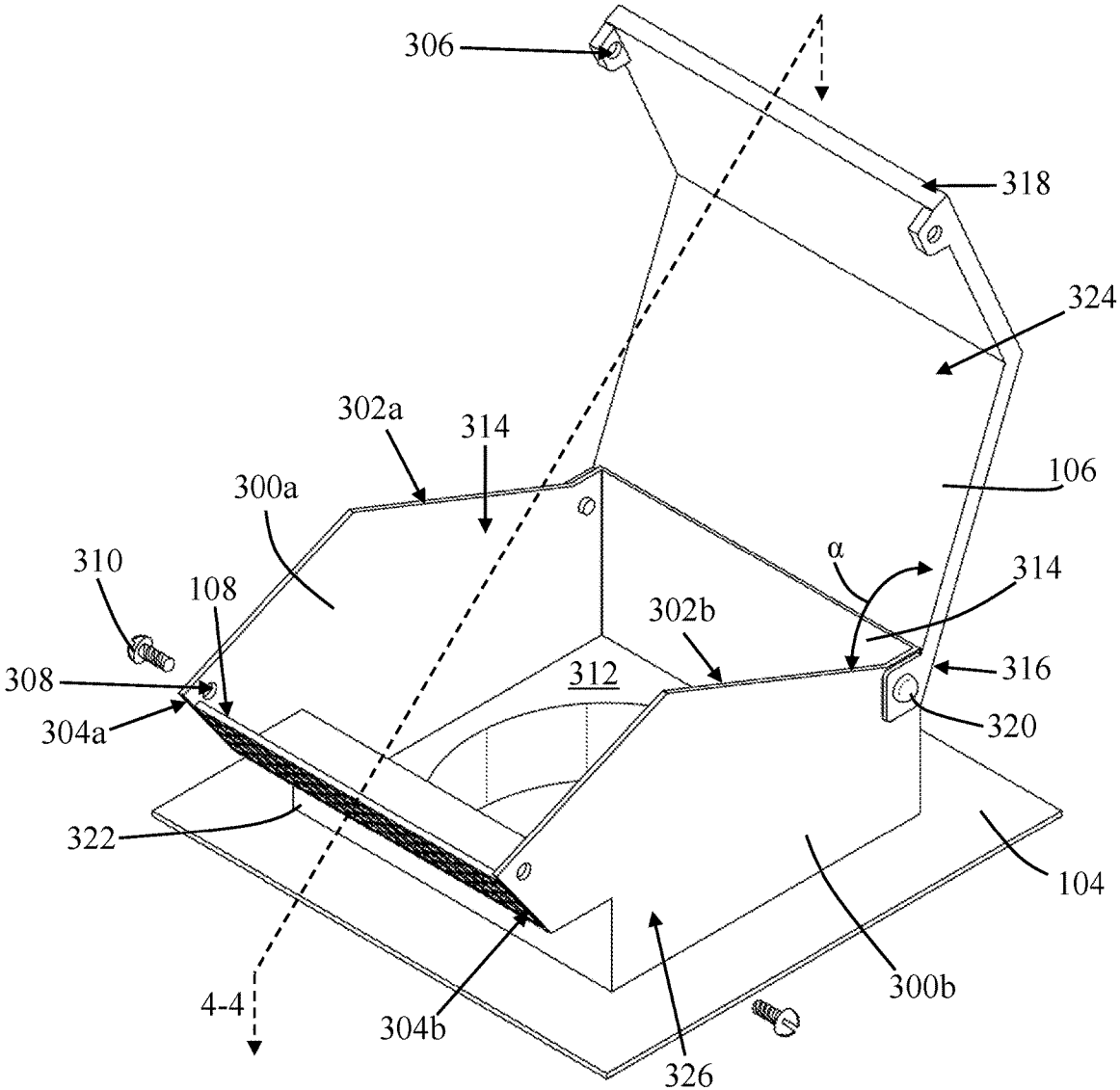
FIG. 3 is an overhead perspective view of the exhaust vent assembly in FIG. 1 with the top in an open position in accordance with one embodiment of the present invention.
Figure 4:
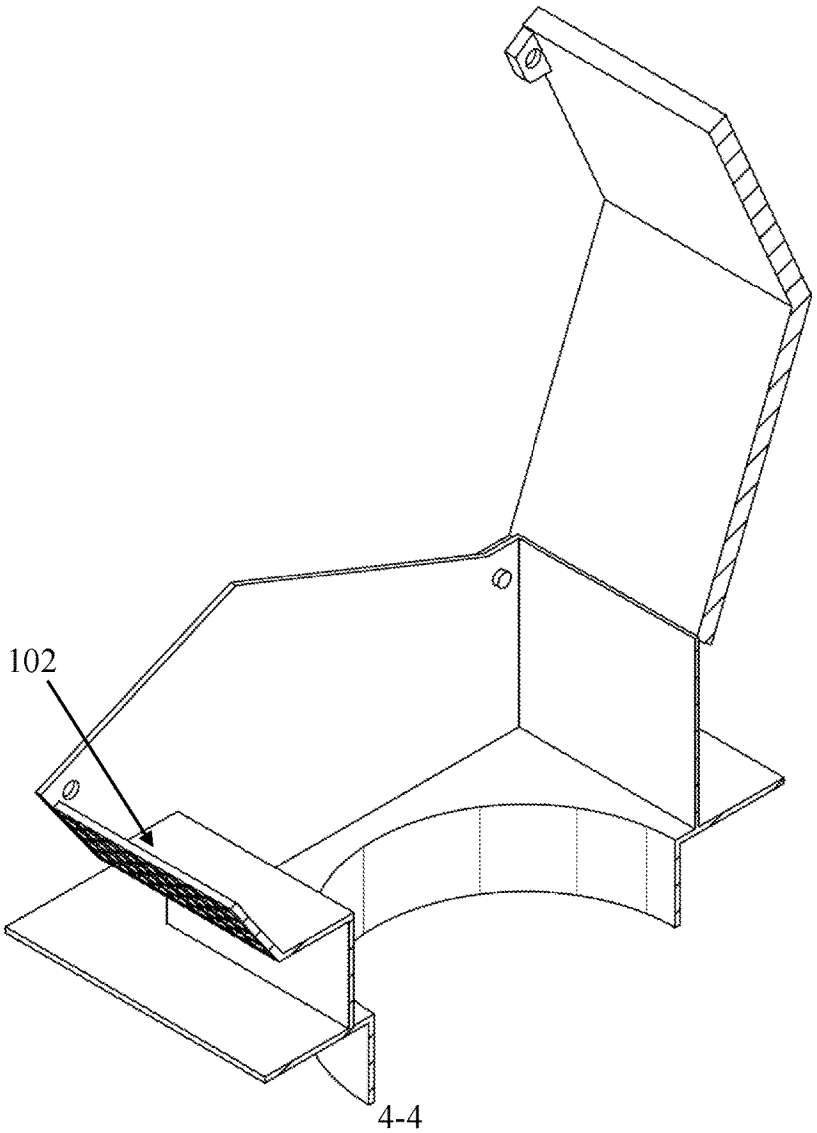
FIG. 4 is an overhead perspective view of the exhaust vent assembly along section line 4-4 in FIG. 3.

With reference to FIGS. 1-3, the present invention provides an exhaust vent assembly 100 with selectively removable top 106 (referred to as "assembly 100" hereinafter for brevity) for effectively and efficiently accessing the vent channel 300 defined by the exhaust vent assembly 100. Embodiments of the invention provide an assembly 100, and utilization method, that may be coupled and operable in association with various building structures.

The exhaust vent assembly 100 is formed with an exhaust vent body 102 that includes a base wall 104, two opposing sidewalls 300*a-b*, a rear wall 304, and a top wall 106 translatably coupled for accessing a vent channel 312, wherein the vent channel 312 can be seen spanning from a front of the assembly, where air, debris, and other matter are emitted to the ambient environment, to the conduit aperture 200. The walls forming the vent assembly 100 are preferably of a substantially rigid (for brevity, referred to as "rigid") and waterproof or water-resistant material, e.g., stainless steel or aluminum sheet material. Said another way, the walls are of a thickness (2-25 mm) and rigidity to prevent weather and other outside elements from penetrating or entering through the walls. As used herein, the term "wall" is intended broadly to encompass continuous structures, as well as, separate structures that are coupled together so as to form a substantially continuous external surface. The walls 104, 106, 300*a-b*, 304, can be seen of a plate-like or planar configuration for spatial and airflow efficiency.

Figure 5:
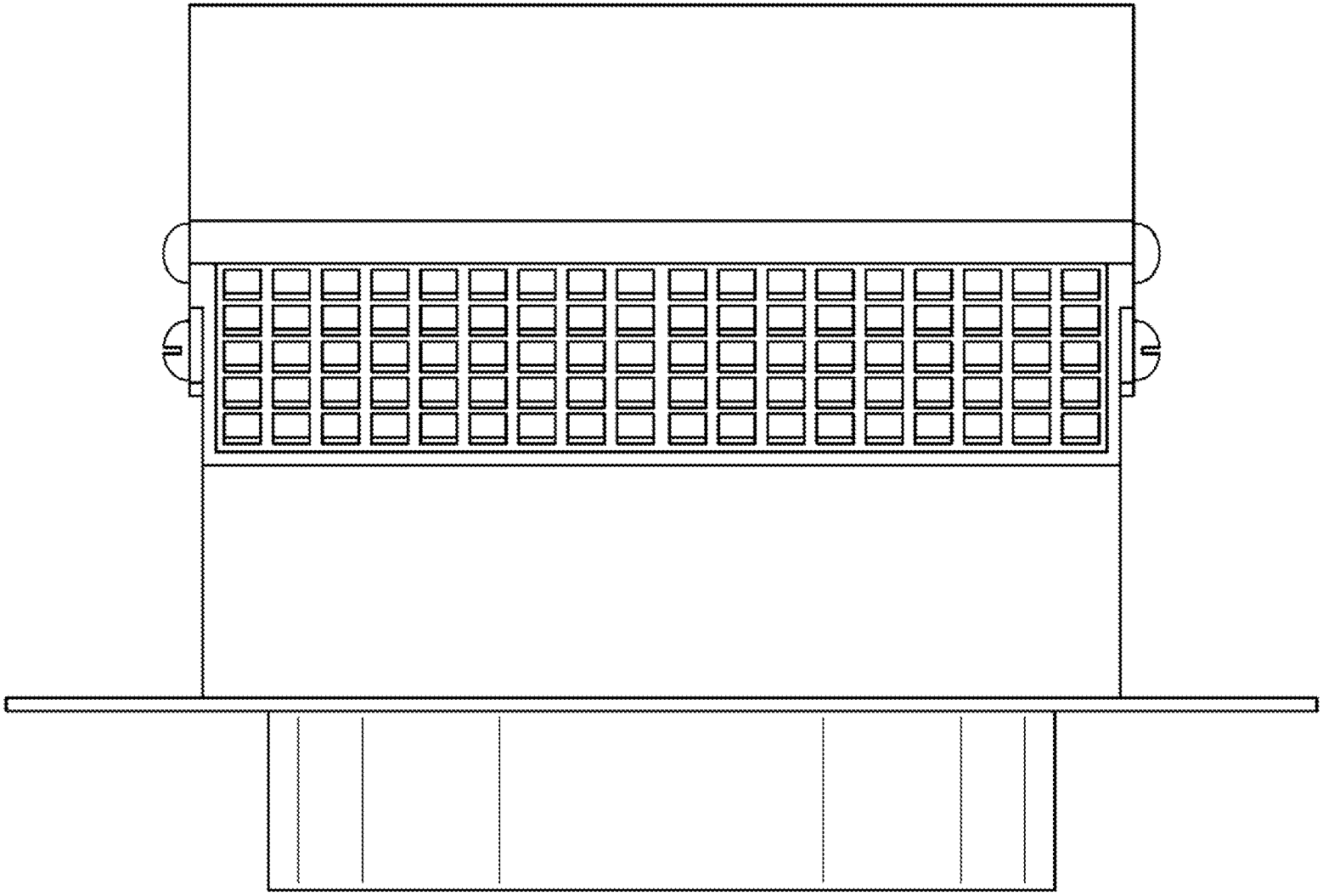
FIG. 5 is an elevational front view of the exhaust vent assembly in FIG. 1.
Figure 6:
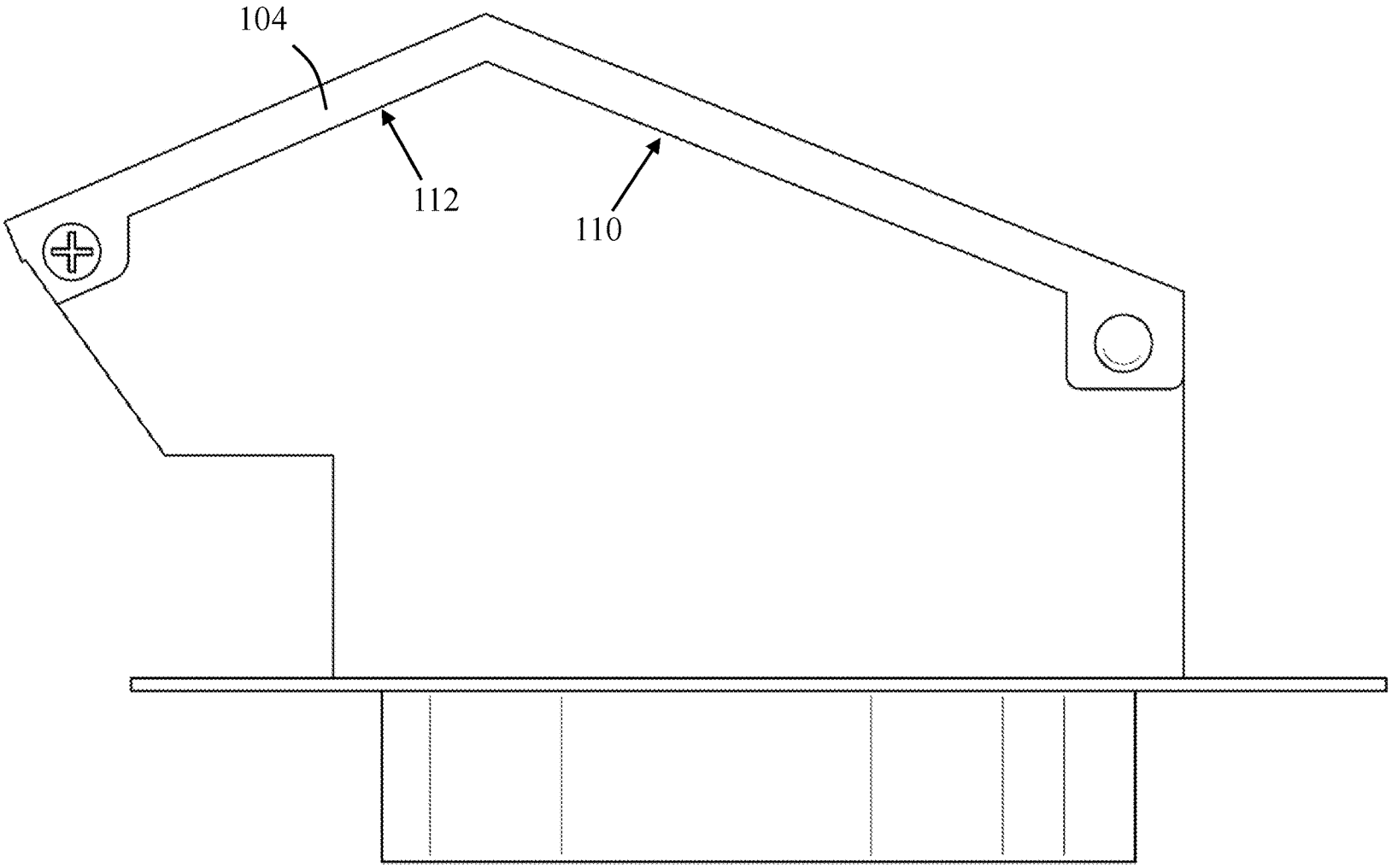
FIG. 6 is an elevational left side view, which would be the same view from the right side, of the exhaust vent assembly in FIG. 1.
Figure 8:
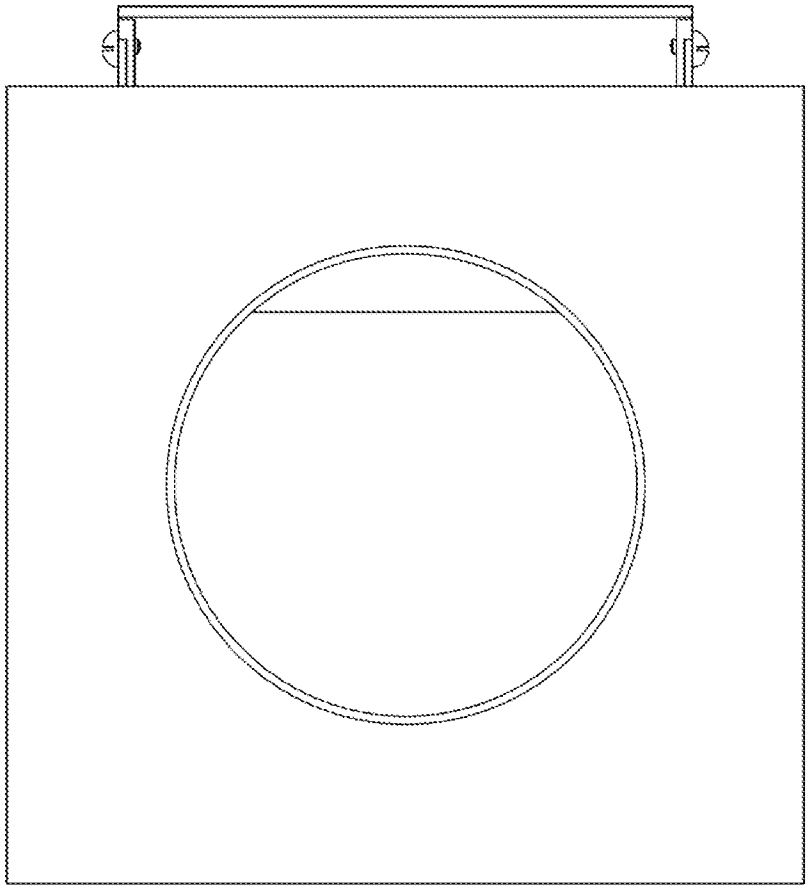
FIG. 8 is a bottom plan view of the exhaust vent assembly in FIG. 1.
Figure 7:
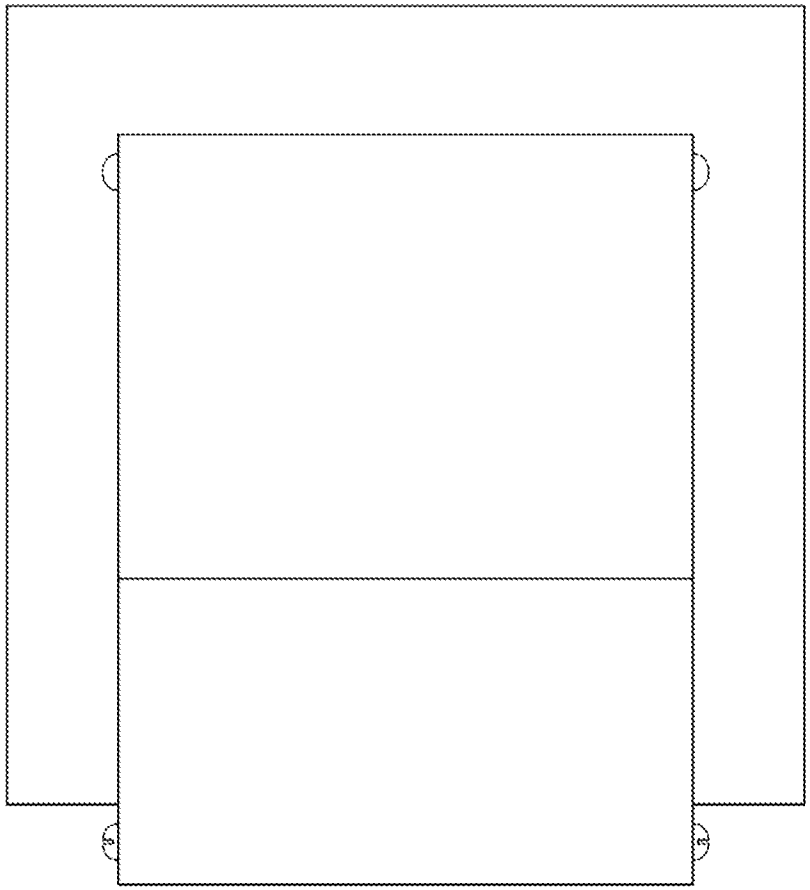
FIG. 7 is a top plan view of the exhaust vent assembly in FIG. 1.

The two opposing sidewalls 300*a-b* and the rear wall 304 are fixedly attached to the base wall 104 and disposed in an upright orientation, e.g., perpendicular. The assembly 100 may also include a front wall 322 interposed between and fixedly attached to the sidewalls 300*a-b* with, for example, welding, adhesive, fasteners, etc. The front wall 322 may also be disposed in an upright orientation and/or include portions angled (e.g., an acute angle) to couple with a mesh screen 116 beneficially coupled to the exhaust vent body 102. More specifically, the front wall 322 may include a perpendicular portion and a horizontal portion that is fixedly coupled to an angled mesh screen 116 adapted to prevent or inhibit animals, insects, debris, and other matter from entering the vent channel 312. To that end, the mesh screen 116 is also preferably of a rigid and waterproof material and defines a plurality of enclosed apertures (as exemplified in FIG. 5) spanning a substantial length of the mesh screen 116 (i.e., greater than 90%). The plurality of apertures may range from 1-10 mm in diameter, but are preferably sized and shaped to permit air and smaller-sized matter to exit the assembly 100 to the ambient environment and prevent animals, insects, and larger-sized matter from entering the assembly 100. The mesh screen 116 may be directly coupled and fastened to the two opposing sidewalls 300*a-b*, namely on an inner surface thereon and may separate the front edges 304*a-b* of each of the two opposing sidewalls 300*a-b*.

Referring to FIGS. 1-4, the base wall 104 can be seen surrounding the sidewalls 300*a-b* and supporting for the upright walls coupled thereto. The base wall 104 can be seen defining a perimeter of the assembly 100 and also defines a centrally located a conduit aperture 200 that fluidly couples the assembly 100 with the conduit of the building structure. Said differently, the base wall 104 includes an upper surface 114 and a bottom surface 202 opposing the upper surface 114 of the base wall 104, wherein an annular adapter member 204 is coupled to the base wall 104 (i.e., integrally formed as a single monolithic piece or coupled with one or more fasteners). The annular adapter member 204 extends in a direction away from the bottom surface 202 of the base wall 104 to define the conduit aperture 200.

The two opposing sidewalls 300*a-b* coupled to the base wall 104 can be seen each having an upper edge 302*a-b* that may be substantially planar and a front edge 304*a-b* that may also be substantially planar. The front edges 304*a-b* of the two opposing sidewalls 300*a-b* define an exhaust port opening 108. Said another way, if there was not attaching structure, like the mesh screen 116, the front of the sidewalls 300*a-b* would define a complete and/or uninhibited opening for accessing the vent channel 312. The upper edges 302*a-b* of the sidewalls 300*a-b* can also be seen defining an upper aperture 314 for also accessing the vent channel 312. To ensure a relatively level configuration between the upper edges 302*a-b* and the top wall 106, the upper edges 302*a-b* are vertically aligned and/or parallel with one another. The top wall 106, namely the inner surface 324 thereof, may include a deformably resilient gasket, e.g., of a natural rubber material, disposed completely over the inner surface 324 or at a position at least partially over the upper edges 302*a-b* when the top wall 106 is disposed in the closed position (exemplified in FIGS. 1-2 and FIGS. 5-8). The gasket will be preferably thin (e.g., approximately 1-10 mm) to effectuate a secure configuration of the top wall 106 when in the close position.

Like the front wall 322, the rear wall 304 may be also coupled to, and interposed between, the two opposing sidewalls 300*a-b*. The top wall 106 may be whole or partially directly coupled to the rear wall 304, but is otherwise translatably coupled to the body 102 to effectuate exposure of and access to the opening 314 and vent channel 312. In one embodiment, the top wall 106 may rotate linearly, curvilinear, or have a rotational movement (exemplified in FIG. 1 with arrow 118). More specifically, the top wall 106 is beneficially and operably configured to have the closed position and an open position (exemplified in FIGS. 3-4) along the top wall translation path 118.

The closed position along the top wall translation path 118 may include the top wall 106 translatably secured and covering the upper edges 302*a-b* of the two opposing sidewalls 300*a-b* and the upper aperture 314. The closed position also includes the mesh screen 116 covering the exhaust port opening 108 (i.e., in front of or within). The open position may or may not include the mesh screen 116 covering the exhaust port opening 108 (depending if the mesh screen 116 is affixed to the top wall 116 or the sidewalls 300*a-b* and/or the front wall 322. The closed position may also include a configuration where the vent channel 312 is enclosed by the top wall 106, two opposing sidewalls 300*a-b*, and base wall 104, wherein the enclosed vent channel 312 spans from the mesh screen 116 to the conduit aperture 200 (as seen or gleaned from the figures). In one embodiment, the closed position will include the top wall 106 flush with the upper edges 302*a-b*, wherein the only outside opening or access to the vent channel 312 will be through the exhaust port opening 108 when coupled to the building structure. Beneficially, the open position of the top wall 106 may include the top wall 106 translatably secured to the body 102 and substantially uncovering the upper edges 302*a-b* of the two opposing sidewalls 300*a-b*, thereby exposing the upper aperture 314 for access. Said another way, at least 75% of the surface area of the upper edges 302*a-b* is not contacting the top wall 106 or having the top wall 106 at least 25 mm removed from the upper edges 302*a-b*. Described differently, the top wall 106 may be operable to open an angle $\alpha$ (shown in FIG. 3) relative to the upper edges 302*a-b* of at least 45°, wherein it is preferred the top wall 106 be operable to open an angle α of at least 90° relative to the upper edges 302*a-b* of at least 45°. In some embodiments, the top wall 106 may be completely removed from the body 102 when in the open position but may have the ability to reattach or couple thereto.

In preferred embodiments, the top wall 106 is rotatably coupled to either or all of the two opposing sidewalls 300*a-b* and/or the rear wall 304 with a pin or other fastener (see, for example, fastener 320). The top wall 106 may be rotatably coupled to the sidewalls 300*a-b* with two opposing fasteners that enable the top wall 106 to freely rotate when not secured to the body 102. To effectuate debris runoff and stress on the top wall 106, the top wall 106 includes a first portion 110 rotatably and directly coupled to one or more of the two opposing sidewalls 300*a-b* and/or the rear wall 304, wherein the first portion 110 extends in a direction away from an upper surface 114 of the base wall 104. The top wall 106 also includes a second portion 112 that is integrally or otherwise coupled with the first portion of the top wall 106 and extends in direction toward the upper surface 114 of the base wall 104. Said another way, the top wall 106 may be shaped in a V-configuration or symmetrically sloped configuration.

The top wall 106 may include one or more top locking aperture(s) (see, for example, aperture 306), wherein the top locking aperture(s) may be defined by the second portion 112, preferably on two opposing sides thereof. Correspondingly, the body 102 may include one or more base locking aperture(s) (see, for example, aperture 308), wherein the base locking aperture(s) may be defined by one or more of the two opposing sidewalls 300*a-b*. To that end, the top wall 106 may be of a width slightly wider than the width defined by the two opposing sidewalls 300*a-b* and the top wall 106 may also include a downward shaped flanges (shown best in FIGS. 1-2) on the periphery of each side of the top wall 106 to cover the outer surface 326 of the sidewalls 300*a-b* proximal to the upper edges 302*a-b*. In one embodiment, the flanges may flex, or otherwise act as a fastener, to compressively secure the top wall 106 to the body 102. The closed position of the top wall 106 may also include the one or more top locking aperture(s) 306 and the one or more base locking aperture(s) 308 aligned with one another, wherein the top wall 106 is rotatably or translatable secured (i.e., prevented or inhibited— with at least 1 lbf—from rotating or translating) to the body 102. When utilizing the apertures 306, 308, the top wall 106 may be secured with one or more fastener (see, for example, screw fastener 310) disposed through (and threaded therein) the at least one top locking aperture 306 and the at least one base locking aperture 308.

When utilizing the apertures 306, 308 and fastener 310 to secure the top wall 106 at one end opposite where the top wall 106 is hinged, the mesh screen 116 may be directly coupled and fastened to the two opposing sidewalls 300*a-b* and with the top and base locking apertures 306, 308 interposed (longitudinally) between the mesh screen 116 and the rear wall 304. Said another way, the mesh screen 116 is the disposed at the outermost longitudinal extent of the assembly 100 such that portion of the wall 106 that is secured is between the mesh screen 116 and the rear wall 314. The top wall 106 may be rotatably coupled to the two opposing sidewalls 300*a-b* proximal (i.e., at or near, within 10% of the overall length of the referencing structure) to a back end 316 of the top wall 106 and rotatably secured to the opposing sidewalls 300*a-b* proximal to a front end 318 of the top wall 106 when in the closed position. The top wall 106 may be rotatably coupled to the two opposing sidewalls 300*a-b* proximal to a back end 316 of the top wall 106 with at least one fastener 320 and rotatably secured to the opposing sidewalls 300*a-b* proximal to a front end 318 of the top wall 106 with at least one fastener 310. When closed, the top wall 106 is disposed over the upper edges 302*a-b* of the two opposing sidewalls 300*a-b* and the upper aperture 314, wherein the top wall 106, the two opposing sidewalls 300*a-b*, and the base wall 104 define an enclosed vent channel 312 spanning from the mesh screen 116 to the conduit aperture 200.

As such, the above-described assembly 100, as reflected in the figures, provides a user the ability to easily, efficiently, and effectively access the vent channel 312 and/or conduit aperture 200, particularly with larger equipment, in an attempt to clear debris or other matter from the conduit fluidly coupled to the assembly 100. The assembly 100 effectuates this access by allowing a user to selectively remove and recouple (and secure) the top wall 106 relative to the base structure or body 102, e.g., by rotating the top wall 106 via a hinge or fastener at one end of the top wall 106 wherein the other opposing end is secured to the base structure or body 102.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above-described features.

What is claimed is:

1. An exhaust vent assembly with selectively removable top comprising:

an exhaust vent body having:

a base wall defining a conduit aperture;

two opposing sidewalls coupled to the base wall and each having an upper edge and a front edge defining an exhaust port opening, the upper edges defining an upper aperture;

a rear wall coupled to, and interposed between, the two opposing sidewalls; and a top wall translatably coupled thereto; and a mesh screen coupled to the exhaust vent body, wherein the top wall is operably configured to have:

a closed position along a top wall translation path with the top wall translatably secured to the exhaust vent body, thereby preventing or inhibiting translation, unless applying at least 1 lbf to the top wall, and covering the upper edges of the two opposing sidewalls and the upper aperture, with the mesh screen covering the exhaust port opening, and defining a vent channel enclosed by the top wall, two opposing sidewalls, and base wall that spans from the mesh screen to the conduit aperture; and an open position along the top wall translation path with the top wall substantially uncovering the upper edges of the two opposing sidewalls and the upper aperture.

2. The exhaust vent assembly according to claim 1, wherein the two opposing sidewalls and the rear wall are fixedly attached to the base wall in an upright orientation.

3. The exhaust vent assembly according to claim 2, wherein the base wall further comprises:

an upper surface and a bottom surface opposing the upper surface of the base wall; and an annular adapter member coupled to the base wall and extending in a direction away from the bottom surface of the base wall, the annular adapter member defining the conduit aperture.

4. The exhaust vent assembly according to claim 1, wherein the top wall is rotatably coupled to at least one of the two opposing sidewalls and the rear wall.

5. The exhaust vent assembly according to claim 1, wherein the top wall further comprises:

a first portion rotatably and directly coupled to the at least one of the two opposing sidewalls and the rear wall and extending in a direction away from an upper surface of the base wall; and a second portion integrally coupled with the first portion of the top wall and extending in direction toward the upper surface of the base wall.

6. The exhaust vent assembly according to claim 5, further comprising:

at least one top locking aperture defined by the second portion; and at least one base locking aperture defined by at least one of the two opposing sidewalls, the closed position including the at least one top locking aperture and the at least one base locking aperture aligned with one another and the top wall rotatably secured with at least one fastener disposed through the at least one top locking aperture and the at least one base locking aperture.

7. The exhaust vent assembly according to claim 6, wherein the mesh screen is directly coupled and fastened the two opposing sidewalls and the at least one top locking aperture and the at least one base locking aperture are interposed between the mesh screen and the rear wall.

8. The exhaust vent assembly according to claim 1, wherein the top wall is rotatably coupled to the exhaust vent body and the closed position includes the top wall rotationally secured with at least one fastener.

9. The exhaust vent assembly according to claim 8, further comprising:

at least one top locking aperture defined by the top wall; and at least one base locking aperture defined by at least one of the two opposing sidewalls, the closed position including the at least one top locking aperture and the at least one base locking aperture aligned with one another and the top wall rotatably secured with the least one fastener disposed through the at least one top locking aperture and the at least one base locking aperture.

10. The exhaust vent assembly according to claim 9, wherein the mesh screen is directly coupled and fastened the two opposing sidewalls and the at least one top locking aperture and the at least one base locking aperture are interposed between the mesh screen and the rear wall.

11. The exhaust vent assembly according to claim 1, wherein the mesh screen separates the front edges of each of the two opposing sidewalls.

12. The exhaust vent assembly according to claim 1, wherein the top wall is rotatably coupled to the two opposing sidewalls proximal to a back end of the top wall and rotatably secured to the two opposing sidewalls proximal to a front end of the top wall when in the closed position.

13. An exhaust vent assembly with selectively removable top comprising:

an exhaust vent body having a base wall defining a conduit aperture, two opposing sidewalls coupled to the base wall and each having an upper edge defining an upper aperture and a front edge defining an exhaust port opening with a mesh screen disposed therein and coupled to the exhaust vent body, a rear wall coupled to, and interposed between, the two opposing sidewalls, having at least one base locking aperture defined by at least one of the two opposing sidewalls, and a top wall:

having a first portion rotatably and directly coupled to the at least one of the two opposing sidewalls and the rear wall and extending in a direction away from an upper surface of the base wall;

having a second portion integrally coupled with the first portion of the top wall, extending in direction toward the upper surface of the base wall, and defining at least one top locking aperture;

rotatably coupled to the two opposing sidewalls proximal to a back end of the top wall with at least one fastener;

rotatably secured to the two opposing sidewalls proximal to a front end of the top wall with at least one fastener;

disposed over the upper edges of the two opposing sidewalls and the upper aperture, wherein the top wall, the two opposing sidewalls, and the base wall define an enclosed vent channel spanning from the mesh screen to the conduit aperture; and having a closed position including the at least one top locking aperture and the at least one base locking aperture aligned with one another and the top wall rotatably secured with the at least one fastener disposed through the at least one top locking aperture and the at least one base locking aperture.

14. The exhaust vent assembly according to claim 13, wherein the two opposing sidewalls and the rear wall are fixedly attached to the base wall in an upright orientation.

15. The exhaust vent assembly according to claim 14, wherein the base wall further comprises:

an upper surface and a bottom surface opposing the upper surface of the base wall; and an annular adapter member coupled to the base wall and extending in a direction away from the bottom surface of the base wall, the annular adapter member defining the conduit aperture.

16. The exhaust vent assembly according to claim 13, wherein the mesh screen is directly coupled and fastened the two opposing sidewalls and the at least one top locking aperture and the at least one base locking aperture are interposed between the mesh screen and the rear wall.

17. The exhaust vent assembly according to claim 13, wherein the mesh screen separates the front edges of each of the two opposing sidewalls.

18. An exhaust vent assembly with selectively removable top comprising:

an exhaust vent body having:

a base wall defining a conduit aperture;

two opposing sidewalls coupled to the base wall and each having an upper edge and a front edge defining an exhaust port opening, the upper edges defining an upper aperture;

a rear wall coupled to, and interposed between, the two opposing sidewalls;

at least one base locking aperture defined by at least one of the two opposing sidewalls; and a top wall translatably coupled thereto and defining at least one top locking aperture; and a mesh screen coupled to the exhaust vent body, wherein the top wall is operably configured to have:

a closed position along a top wall translation path with the top wall translatably secured and covering the upper edges of the two opposing sidewalls and the upper aperture, with the mesh screen covering the exhaust port opening, and defining a vent channel enclosed by the top wall, two opposing sidewalls, and base wall that spans from the mesh screen to the conduit aperture, the closed position including the at least one top locking aperture and the at least one base locking aperture aligned with one another and the top wall rotatably secured with the least one fastener disposed through the at least one top locking aperture and the at least one base locking aperture; and an open position along the top wall translation path with the top wall substantially uncovering the upper edges of the two opposing sidewalls and the upper aperture.

* * * * *